US010400544B2

(12) United States Patent
Stokley et al.

(10) Patent No.: US 10,400,544 B2
(45) Date of Patent: Sep. 3, 2019

(54) CEMENT PLUG TRACKING WITH FIBER OPTICS

(71) Applicant: Halliburton Energy Services, Inc., Houston, TX (US)

(72) Inventors: Christopher Lee Stokley, Houston, TX (US); Timothy R. Tips, Montgomery, TX (US); Paul F. Rodney, Spring, TX (US); John Laureto Maida, Houston, TX (US); Krishna M. Ravi, Kingwood, TX (US); Jamaal Brickhouse, Spring, TX (US); Luke Christopher Downey, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 136 days.

(21) Appl. No.: 15/559,525

(22) PCT Filed: May 15, 2015

(86) PCT No.: PCT/US2015/031048
§ 371 (c)(1),
(2) Date: Sep. 19, 2017

(87) PCT Pub. No.: WO2016/186612
PCT Pub. Date: Nov. 24, 2016

(65) Prior Publication Data

US 2018/0245424 A1 Aug. 30, 2018

(51) Int. Cl.

| | |
|---|---|
| ***E21B 33/16*** | (2006.01) |
| ***E21B 47/09*** | (2012.01) |
| ***E21B 47/12*** | (2012.01) |

(52) U.S. Cl.
CPC ..... *E21B 33/16* (2013.01); *E21B 47/0905* (2013.01); *E21B 47/123* (2013.01)

(58) Field of Classification Search
CPC .... E21B 47/123; E21B 47/0905; E21B 33/16; E21B 47/09; E21B 47/0005; E21B 47/10
See application file for complete search history.

(56) References Cited

U.S. PATENT DOCUMENTS

| | | |
|---|---|---|
| 2,558,427 A | 6/1951 | Fagan |
| 5,199,689 A | 4/1993 | Proud et al. |

(Continued)

FOREIGN PATENT DOCUMENTS

| | | |
|---|---|---|
| WO | 2014099066 | 6/2014 |

OTHER PUBLICATIONS

"Deployable Reels—Portable Fiber Optic Storage Reels", Available Online at: https://web.archive.org/web/20101211120031/http://www.timbercon.com/deployable-reels/, Dec. 11, 2010, 2 pages.

(Continued)

*Primary Examiner* — Daniel P Stephenson
(74) *Attorney, Agent, or Firm* — Kilpatrick Townsend & Stockton LLP

(57) ABSTRACT

A system can include a cementing tool positionable within a casing string of a wellbore. A receiver that is positionable at the surface of the wellbore can receive an optical signal. A locator coupled to the cementing tool can generate an electrical signal in response to detecting a change in a surrounding magnetic field. A light source can generate an optical signal. A fiber optic cable can transmit the optical signal generated by the light source. A fiber reel can dispense the fiber optic cable from an end of the fiber optic cable.

19 Claims, 3 Drawing Sheets

(56) References Cited

U.S. PATENT DOCUMENTS

| | | | | |
|---|---|---|---|---|
| 5,573,225 | A | 11/1996 | Boyle et al. | |
| 6,041,872 | A | 3/2000 | Holcomb et al. | |
| 6,188,645 | B1 | 2/2001 | Maida, Jr. et al. | |
| RE37,283 | E | 7/2001 | Kluth et al. | |
| 6,256,588 | B1 | 7/2001 | Maida, Jr. et al. | |
| 6,561,488 | B1 * | 5/2003 | Walker | G02B 6/4464 15/104.061 |
| 6,634,425 | B2 | 10/2003 | King et al. | |
| 6,847,034 | B2 * | 1/2005 | Shah | E21B 23/08 166/250.01 |
| 7,077,200 | B1 | 7/2006 | Adnan et al. | |
| 7,133,582 | B1 * | 11/2006 | Moslehi | G02B 6/02195 385/13 |
| 7,140,435 | B2 * | 11/2006 | Defretin | E21B 47/10 166/255.1 |
| 8,305,228 | B2 | 11/2012 | Vigneaux | |
| 8,408,064 | B2 | 4/2013 | Hartog et al. | |
| 8,517,096 | B2 * | 8/2013 | Vigneaux | E21B 47/102 166/253.1 |
| 8,636,063 | B2 | 1/2014 | Ravi et al. | |
| 9,127,531 | B2 * | 9/2015 | Maida | E21B 47/123 |
| 9,222,349 | B2 * | 12/2015 | LeBlanc | E21B 33/16 |
| 2003/0010500 | A1 * | 1/2003 | Smith | E21B 47/0001 166/336 |
| 2004/0060697 | A1 | 4/2004 | Tilton et al. | |
| 2005/0034857 | A1 | 2/2005 | Defretin et al. | |
| 2005/0263281 | A1 | 12/2005 | Lovell et al. | |
| 2006/0157239 | A1 * | 7/2006 | Ramos | E21B 47/09 166/254.2 |
| 2008/0272931 | A1 | 11/2008 | Auzerais et al. | |
| 2009/0219171 | A1 | 9/2009 | Vigneaux | |
| 2011/0090496 | A1 | 4/2011 | Samson et al. | |
| 2011/0139447 | A1 | 6/2011 | Ramos et al. | |
| 2012/0085531 | A1 * | 4/2012 | Leising | E21B 47/00 166/77.2 |
| 2012/0118567 | A1 | 5/2012 | Cooke et al. | |
| 2013/0021874 | A1 | 1/2013 | Hartog et al. | |
| 2013/0056197 | A1 | 3/2013 | Maida et al. | |
| 2013/0056202 | A1 | 3/2013 | Maida et al. | |
| 2013/0249705 | A1 | 9/2013 | Sharp et al. | |
| 2013/0255939 | A1 | 10/2013 | Kumaran et al. | |
| 2014/0034301 | A1 | 2/2014 | LeBlanc et al. | |
| 2014/0131035 | A1 | 5/2014 | Entchev et al. | |
| 2019/0033052 | A1 * | 1/2019 | Amineh | G01B 21/08 |

OTHER PUBLICATIONS

Australian Patent Application No. AU2015395615 , "First Examination Report", Dec. 7, 2018, 9 pages.

Australian Patent Application No. AU 2015395615, "Second Examination Report", Feb. 13, 2019, 9 pages.

International Patent Application No. PCT/US2015/031048, "International Search Report and Written Opinion", Jan. 28, 2016, 16 pages.

* cited by examiner

CEMENT PLUG TRACKING WITH FIBER OPTICS

TECHNICAL FIELD

The present disclosure relates generally to systems and methods for completing a wellbore, and more specifically (although not necessarily exclusively), to systems and methods for tracking the location of a cementing tool using fiber optic telemetry.

BACKGROUND

During completion of the wellbore the annular space between the wellbore wall and a casing string (or casing) can be filled with cement. This process can be referred to as "cementing" the wellbore. A lower plug can be inserted into the casing string after which cement can be pumped into the casing string. An upper plug can be inserted into the wellbore after a desired amount of cement has been injected. The upper plug, the cement, and the lower plug can be forced downhole by injecting displacement fluid into the casing string. Variations in pressure of the displacement fluid can be used to determine the location of the upper plug, the cement, and the lower plug. These variations in pressure can be small and may not always be detected or may be incorrectly interpreted. Knowing the position of the upper plug, and thereby the cement below it, can prevent damage to the well or other errors in the cementing process. For example, variations in the pressure of the displacement fluid when the lower plug gets trapped at an undesired location in the casing string can be incorrectly interpreted to mean the lower plug has reached its destination at a float collar at the bottom of the casing string. Knowing the location of the upper cement plug can increase the integrity of the well.

DETAILED DESCRIPTION

Figure 1:
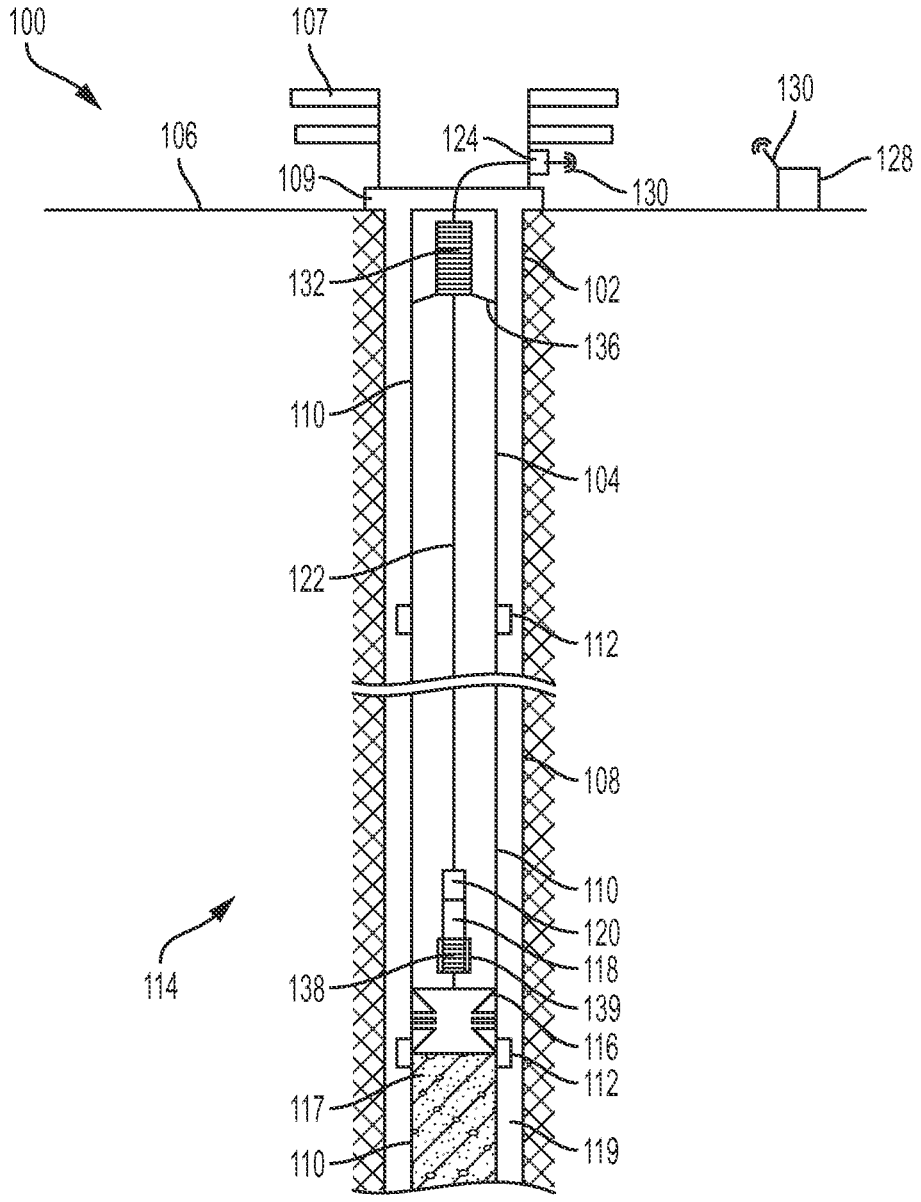
FIG. 1 is a schematic diagram of a well system for cementing a wellbore and tracking a cementing tool, according to an example of the present disclosure.

Certain aspects and features of the present disclosure relate to a system for tracking the position of a cementing tool during a cementing application using fiber optic telemetry. The wellbore can include a casing string that includes one or more casing collars. The cementing tool, for example a cement plug or a dart, can be positioned within the casing string. The cementing tool can be coupled to the locator device. The locator device can be, for example, a magnetic pickup coil that can detect a disturbance or change in a magnetic field or a piezoelectric sensor. The magnetic field surrounding the locator device can be disturbed when the locator device passes a casing collar. The change in the magnetic field can induce a voltage in the locator device. The locator device can be coupled to a light source, for example a light emitting diode ("LED"), The voltage generated by the locator device can briefly energize the light source and cause the light source to emit a pulse of light.

The light source can be coupled to a fiber optic cable that can extend to the surface. The fiber optic cable can be dispensed on one or both ends by a bobbin or reel. The fiber optic cable can transmit the pulse of light to a receiver, for example a photodetector, positioned at the surface. The receiver can detect the arrival of the pulse of light. In some aspects, the receiver can include a counter that can count the number of light pulses received as the locator device and the cementing tool travel downhole. The number of light pulses received by the receiver can correspond to the number of casing collars the locator device, and therefore the cementing tool, passed. The number of casing collars can indicate the position of the locator and cementing tool within the wellbore. In some aspects, the receiver can transmit information regarding the light pulses to a device located away from the wellbore surface.

The fiber optic cable can be dispensed (or unspooled) at one end by a reel (or bobbin) positioned proximate to the cementing tool. An additional reel can be positioned proximate to the surface of the wellbore and can also unspool additional lengths of the fiber optic cable. The reels can dispense the additional lengths of fiber optic cable in response to a tension in the fiber optic cable exceeding a pre-set value. The reels can prevent the fiber optic cable from breaking or otherwise becoming damaged as the cementing tool coupled to the fiber optic cable travels downhole. The fiber optic cable can be unarmored, which can increase the amount of cable that can be spooled on the reels. The fiber optic cable can be a sacrificial cable that remains within the wellbore until it, ultimately, is destroyed during wellbore operations, for example during stimulation.

In some aspects, additional sensors can be coupled to the fiber optic cable for monitoring various conditions within the wellbore. An additional sensor can include, but is not limited to, a temperature sensor, an acoustic sensor, a pressure sensor, a chemical sensor, an accelerometer, or other sensors for monitoring a condition within the wellbore. These sensors can transmit information about the wellbore conditions to the surface via the fiber optic cable.

Additional methods for monitoring the location of the cementing tool can also be utilized in conjunction with the systems and methods described herein. An additional method may include monitoring wellbore fluid pressure from the surface to determine when a cementing tool reaches a key location during cementing. For example, the wellbore fluid pressure can increase when the lower plug arrives at a float collar positioned at the bottom of the casing string. However, changes in the wellbore fluid pressure can be very small, just a few hundred pounds per square inch, and may be missed at the surface.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a schematic diagram of a well system 100 for tracking the location of a cementing tool using fiber optic telemetry. The well system 100 can include a wellbore 102 with a casing string 104 extending from the surface 106 through the wellbore 102. A blowout preventer 107 ("BOP") can be positioned above a wellhead 109 at the surface 106. The wellbore 102 extends through various earth strata and may have a substantially vertical section 108. In some aspects, the wellbore 102 can also include a substantially horizontal section. The casing string 104 includes multiple casing tubes 110 coupled together end-to-end by casing collars 112. In some aspects; the casing tubes 110 are approximately thirty feet in length. The substantially vertical section 108 may extend through a hydrocarbon bearing subterranean formation 114.

A cementing tool, for example a cement plug 116 can be positioned downhole in the casing string 104. The cement plug 116 can be an upper cement plug that is inserted into the casing string 104 after a desired amount of cement 117 has been injected into the casing string 104. In some aspects, a dart for plugging a cement plug can be used in place of the cement plug 116. The cement plug 116 can be forced downhole by the injection of displacement fluid from the surface 106. A lower cement plug can be positioned below the cement 117 and can be forced downhole until it rests on a floating collar at the bottom of the casing string 104. The cement plug 116 can be forced downhole until it contacts the lower cement plug. The cement plug 116 can force the cement 117 downhole until it ruptures the lower cement plug and is forced out of a shoe of the casing string 104. The cement 117 can flow out of the casing string 104 and into the annulus 119 of the wellbore 102. Knowing the position of the cement plug 116 within the wellbore 102 can prevent errors in the cementing process and can increase the integrity of the well.

The cement plug 116 can be coupled to a locator device that can generate a voltage in response to a change in a surrounding magnetic field. In some aspects, the locator device can be a magnetic pickup coil 118. In some aspects, a piezoelectric sensor or other suitable locator device can be used. The magnetic pickup coil 118 can include a permanent magnet with a coil wrapped around it. The casing tubes 110 can each emit a magnetic field. Each casing collar 112 can emit a magnetic field that is different from the magnetic field emitted by the casing tubes 110 joined by the casing collar 112. The change in the magnetic field between the casing collars 112 and the casing tubes 110 can be detected by the magnetic pickup coil 118. The magnetic pickup coil 118 can generate a voltage in response to the change in the surrounding magnetic field when the magnetic pickup coil 118 passes a casing collar 112. The voltage generated by the magnetic pickup coil 118 can be in proportion to the velocity of the magnetic pickup coil as 118 as it travels past the casing collar 112. In some aspects, the magnetic pickup coil 118 can travel between approximately 10 feet per second and approximately 30 feet per second.

The magnetic pickup coil 118 can be coupled to a light source, for example an LED 120. The voltage generated by the magnetic pickup coil 118 can momentarily energize the LED 120 coupled to the magnetic pickup coil 118. The LED 12.0 can generate a pulse of light (e.g., an optical signal) in response to the voltage generated by the magnetic pickup coil 118. The LED 120 can transmit the pulse of light to a receiver 124 positioned at the surface 106. In some aspects, the LED 120 can operate at a 1300 nm wavelength which can minimize Rayleigh transmission losses and hydrogen-induced and coil bend-induced optical power losses. In some aspects, high speed laser diode or other optical sources can be used in place of the LED 120 and various other optical wavelengths can be used. For example, wavelengths from about 850 nm to 2100 nm can make use of the optical low-loss transmission wavelength bands in ordinary fused silica multimode and single mode optical fibers.

The drive circuit of the LED 120 can require a minimum voltage be generated by the magnetic pickup coil 118 to complete the circuit and generate the pulse of light. In some aspects, the drive circuit of the LED 120 can be biased with energy from a battery or other energy source. The biased drive circuit of the LED 120 can require less voltage be induced in the magnetic pickup coil 118 to complete the circuit and generate the pulse of light. The biased drive circuit of the LED 120 can allow small changes in the magnetic field sensed by the magnetic pickup coil 118 to generate a sufficient voltage to energize the LED 120. In some aspects, the biased drive circuit of the LED 120 can allow the magnetic pickup coil 118 traveling at a low velocity past a casing collar 112 to generate enough voltage to complete the circuit of the LED 120 and emit a pulse of light. In some aspects, a light source can be positioned proximate to the surface 106 and can transmit an optical signal downhole to determine the location of a collar locator within the casing string 104.

The pulse of light generated by the LED 120 can be transmitted to the receiver 124 positioned at the surface 106 using a fiber optic cable 122. The receiver 124 can be an optical receiver, for example a photodetector that can convert the optical signal into electricity. In some aspects, the receiver 124 can count the number of pulses of light received via the fiber optic cable 122. The number of light pulses received by the receiver 124 can indicate the number of casing collars 112 the magnetic pickup coil 118 and cement plug 116 have passed. The wellbore 102 can be mapped at the surface based on the number of casing tubes 110 positioned within the wellbore 102 and their respective lengths. The number of casing collars 112 the cement plug 116 has passed can indicate the position of the cement plug 116 within the wellbore. In some aspects, the receiver 124 can transmit information to the magnetic pickup coil 118 or other collar locator via the fiber optic cable 122.

The receiver 124 can be communicatively coupled to a computing device 128 located away from the wellbore 102 by a communication link 130. The communication link 130 is a wireless communication link. The communication link 130 can include wireless interfaces such as IEEE 802.11. Bluetooth, or radio interfaces for accessing cellular telephone networks (e.g., transceiver/antenna for accessing a CDMA, GSM, UMTS, or other mobile communications network). In some aspects the communication link 130 may be wired. A wired communication link can include interfaces such as Ethernet, USB, IEEE 1394, or a fiber optic interface. The receiver 124 can transmit information related to the optical signal, for example but not limited to the light pulse count, the time the light pulse arrived, or other information, to the computing device 128. In some aspects, the receiver 124 can be coupled to a transmitter that communicates with the computing device 128.

The fiber optic cable 122 that transmits the light pulse to from the LED 120 to the receiver 124 can be an unarmored fiber. The unarmored fiber can include a fiber core and a cladding but no outer buffer. In some aspects, the fiber optic cable 122 can be an armored fiber. The armored fiber can include a fiber core, a cladding, and an outer buffer. The inclusion of the outer buffer can increase the diameter of the fiber optic cable. The fiber optic cable 122 can be a multimode or single-mode optical fiber. The fiber optic cable 122 can include one or more optical fibers. The fiber optic cable 122 can be a sacrificial cable that is not retrieved from the wellbore 102 but instead remains in the wellbore 102 until it is destroyed. For example, the fiber optic cable 122 can be destroyed during stimulation of the wellbore 102.

The fiber optic cable 122 can be dispensed from an upper bobbin or reel 132 positioned within the wellbore 102 proximate to the surface 106 as the cement plug 116 is forced downhole. In some aspects, the upper reel 132 can be positioned at the surface 106, for example proximate to the blowout preventer 107. The upper reel 132 can be secured within the wellbore 102 by a securing device, for example by spring loaded camming feet 136 or other suitable securing mechanisms. The upper reel 132 can have a zero tension payout that can dispense the fiber optic cable 122 when there is a tension in the fiber optic cable 122.

The fiber optic cable 122 can be tensioned by and pulled along with the displacement fluid being injected into the casing string 104 to move the cement plug 116, The upper reel 132 can dispense additional lengths of the fiber optic cable 122 as the fiber optic cable 122 is tensioned by the displacement fluid injected into the wellbore 102. In some aspects, the fiber optic cable 122 can spool off the upper reel 132 at the same rate as the flow of the displacement fluid. The upper reel 132 can prevent the fiber optic cable from breaking or otherwise becoming damaged as the fiber optic cable 122 and the cement plug 116 travel downhole.

The fiber optic cable 122 can also be spooled on and dispensed from a lower bobbin or reel 138 positioned proximate to the magnetic pickup coil 118. The lower reel 138 can include a drag device 139. The drag device 139 can allow the lower reel 138 to dispense the fiber optic cable 122 only when a pre-set tension in the fiber optic cable 122 is reached. The lower reel 138 can prevent the fiber optic cable from breaking or otherwise becoming damaged as the fiber optic cable 122 and the cement plug 116 travel downhole. The upper reel 132 and the lower reel 138 can store greater lengths of unarmored fiber optic cable than armored fiber optic cable. While FIG. 1 depicts the lower reel 138 positioned below the LED 120 and the magnetic pickup coil 118, in some aspects the lower reel 138 could be positioned elsewhere with respect to the LED 120 and the magnetic pickup coil 118.

Figure 2:
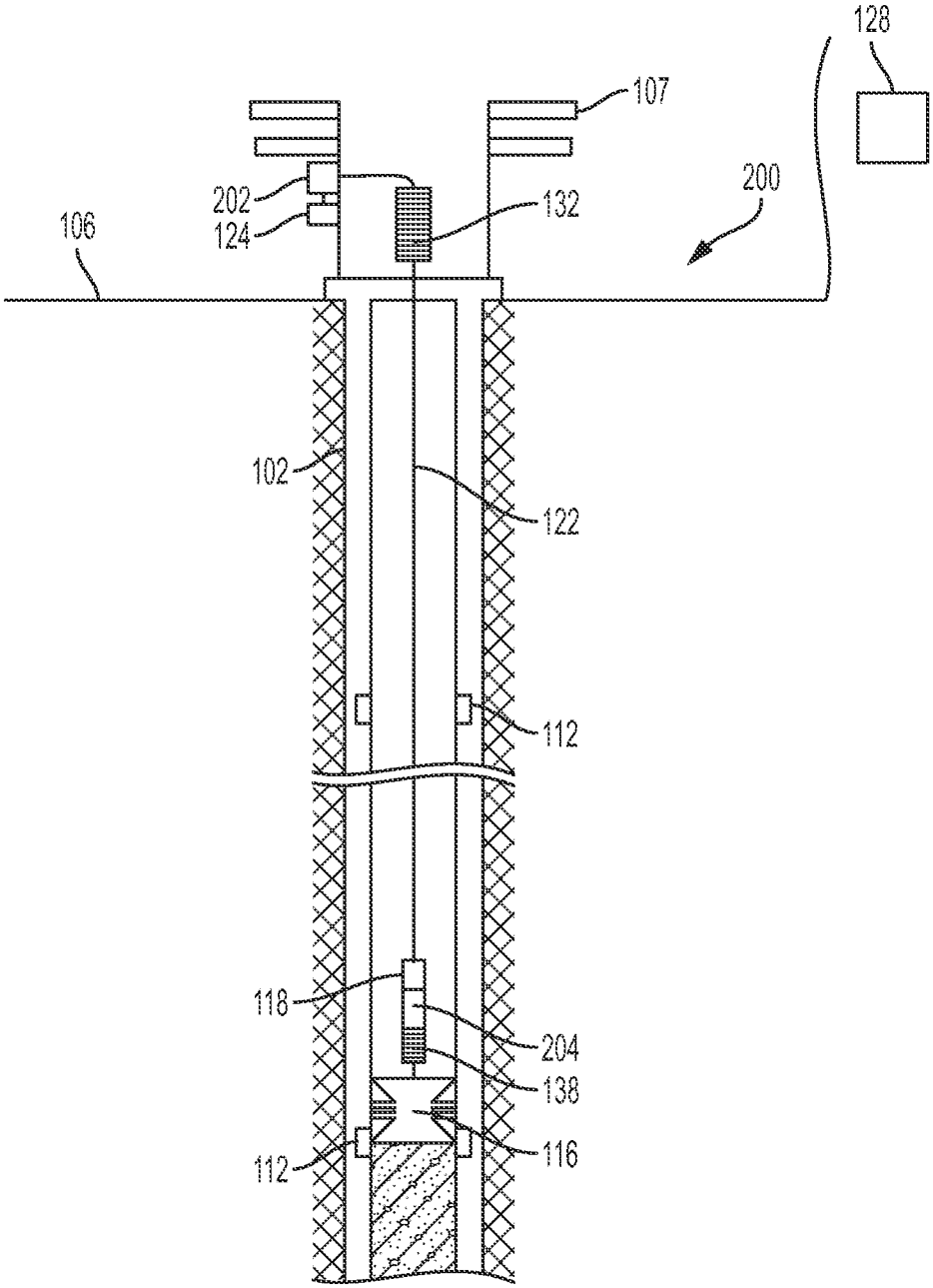
FIG. 2 is a schematic diagram of a well system for cementing a wellbore and tracking a cementing tool, according to another example of the present disclosure.

FIG. 2 is a schematic diagram of another example of a well system 200 for tracking the location of a cementing tool, the system 200 including a light source that is a laser 202. The laser 202 can be positioned at the surface 106 proximate to the BOP 107. The laser 202 is coupled to the fiber optic cable 122 which can be dispensed at an end by the upper reel 132. The upper reel 132 can be positioned at the surface 106 proximate to the BOP 107. In some aspects the laser 202 and the upper reel 132 can be positioned elsewhere at the surface 106 or within the wellbore 102.

The laser 202 can be a high repetition pulse laser or other suitable light source. The laser 202 can generate an optical signal, for example, a series of light pulses that are transmitted by the fiber optic cable 122. The cement plug 116 can be coupled to the lower reel 138, the magnetic pickup coil 118. A modulation device can be coupled to the magnetic pickup coil 118 proximate to an end of the fiber optic cable 122. The modulation device can be, for example but not limited to, a pendulum switch 204. The pendulum switch 204 can include a mirror that can be shifted between two positions.

The optical signal generated by the laser 202 can travel the length of the fiber optic cable 122 and reach a lower end of the fiber optic cable 122 proximate to the lower reel 138. The pendulum switch 204 can be positioned proximate to the lower end of the fiber optic cable. The pendulum switch 204 can modulate the optical signal (e.g., pulses of light) generated by the laser 202 in response to a voltage generated by the magnetic pickup coil 118 as it passes a casing collar 112. In some aspects, a piezoelectric sensor, or another suitable modulation device can be used to modulate the optical signal of the laser 202. In some aspects, the modulation device can modulate, for example but not limited to, the frequency, amplitude, phase, or other suitable characteristic of the optical signal.

The pendulum switch 204 can include a mirror. The position of the mirror of the pendulum switch 204 can be controlled by the magnetic pickup coil 118. The mirror of the pendulum switch 204 can have two positions. In a first position, the mirror of the pendulum switch 204 can reflect the pulse of light arriving at the lower end of the fiber optic cable 122 away from the fiber optic cable 122. The pulse of light can fail to be re-transmitted to the receiver 124 via the fiber optic cable 122. In a second position, the mirror of the pendulum switch 204 reflect the pulse of light back arriving at the lower end of the fiber optic cable 122 back into the fiber optic cable 122. The pulse of light can be re-transmitted to the receiver 124 via the fiber optic cable 122. The position of the mirror of the pendulum switch 204 can be controlled by the magnetic pickup coil 118.

In one aspect, the laser 202 can transmit an optical signal down the fiber optic cable 122 (e.g., a series of light pulses). The magnetic pickup coil 118 can generate a voltage when it passes a casing collar 112. The voltage generated by the magnetic pickup coil 118 can switch the position of the mirror of the pendulum switch 204 from the first position to the second position. In other words, in some aspects voltage generated by the magnetic pickup coil 118 can move the mirror of the pendulum switch 204 to reflect the light pulse away from the fiber optic cable 122.

The receiver 124 at the surface 106 can monitor the light pulses transmitted along the fiber optic cable 122. The receiver 124 can detect when a pulse of light transmitted by the laser 202 is not returned to the receiver 124 via the fiber optic cable 122. The pulse of light that is transmitted downhole by the laser 202 but not transmitted back to the surface 106 can indicate the pendulum switch 204 reflected the light pulse away from the fiber optic cable 122. The pendulum switch 204 can be controlled by the magnetic pickup coil 118 in response to whether a voltage is generated by the magnetic pickup coil 118. The "missed" pulse of light can thereby indicate that the magnetic pickup coil 118 (and therefore the cement plug 116) passed a casing collar 112. In some aspects, the receiver 124 can transmit information regarding the light pulses to the computing device 128 located at a separate location. The location of the cement plug 116 can be determined using the information relating to the light pulses transmitted by the receiver 124, In some aspects, the receiver 124 can include an interferometer. In some aspects, the interferometer can determine the phase of the optical signal.

In some aspects, when there is no voltage generated by the magnetic pickup coil 118 the pendulum switch 204 can be positioned to reflect the optical signal (i.e., the pulse of light) away from the end of the fiber optic cable 122. In this aspect, the pendulum switch 204 can be moved to reflect the optical signal back into the fiber optic cable 122 in response to the magnetic pickup coil 118 generating a voltage when it passes the casing collar 112. The receiver 124 at the surface can detect the arrival of the optical signal, which can indicate the magnetic pickup coil 118 (and the cement plug 116) passed a casing collar 112.

The fiber optic cable 122 can be dispensed from the upper reel 132 in response to the tension in the fiber optic cable 122 increasing above a pre-set limit. The upper reel 132 can have a zero tension payout that releases additional lengths of fiber optic cable 122 when the tension in the fiber optic cable 122 increases beyond zero. The lower reel 138 can also dispense additional lengths of the fiber optic cable 122. The lower reel 138 can include a drag device that can prevent the release of additional lengths of the fiber optic cable 122 until a pre-set tension is reached. In some aspects, only a single reel may be used to dispense the fiber optic cable 122. In aspects in which an upper reel 132 and a lower reel 138 are both used, the shared fiber payout can minimize potential fiber over tension or fiber damage from chaffing against the wellbore or a tubing string. For example, the wellbore 102 can include a bent or highly deviated heel or can curve and become horizontal. The upper reel 132 and the lower reel 138 can prevent the fiber optic cable 122 from breaking, chaffing, or otherwise becoming damaged as the cement plug 116 and fiber optic cable 122 are forced around a curve into a horizontal or lateral wellbore.

In some aspects, the fiber optic cable 122 can be actively dispensed from the upper reel 132 or a lower reel 138 by a motor. In some aspects, one or both of the upper reel 132 and the lower reel 138 can utilize soft high-temperature rated polymer cements or binders to hold the fiber optic cable 122 turns together around the reel. As the fiber optic cable 122 spooled on the applicable reel is dispensed by the increased tension in the cable, the fiber optic cable 122 can be peeled from the outermost layer of the applicable reel.

In some aspects, the location of the cement plug 116 can be controlled in response to the optical signal detected by the receiver 124. For example, the injection of displacement fluid from the surface 106 can be stopped in response to the optical signal detected by the receiver 124 indicating the magnetic pickup coil 118 (and the cement plug 116) have reached a desired location within the wellbore 102. The cement plug 116 can stop moving downhole when the displacement fluid is no longer injected into the wellbore 102. In some aspects, the injection rate of the displacement fluid can be lowered to slow the velocity of the cement plug 116 as it approaches a desired location to better control the placement of the cement plug 116.

Additional techniques for determining the position of the cement plug 116 within the wellbore 102 can be used in conjunction with the present disclosure. For example, the pressure of the displacement fluid can be measured and used to aid in determining when a lower plug arrives at the float collar and other steps in the cementing process. However, the pressure variations monitored can be very small, for example a few hundred pounds per square inch, and may be missed on the surface.

Figure 3:
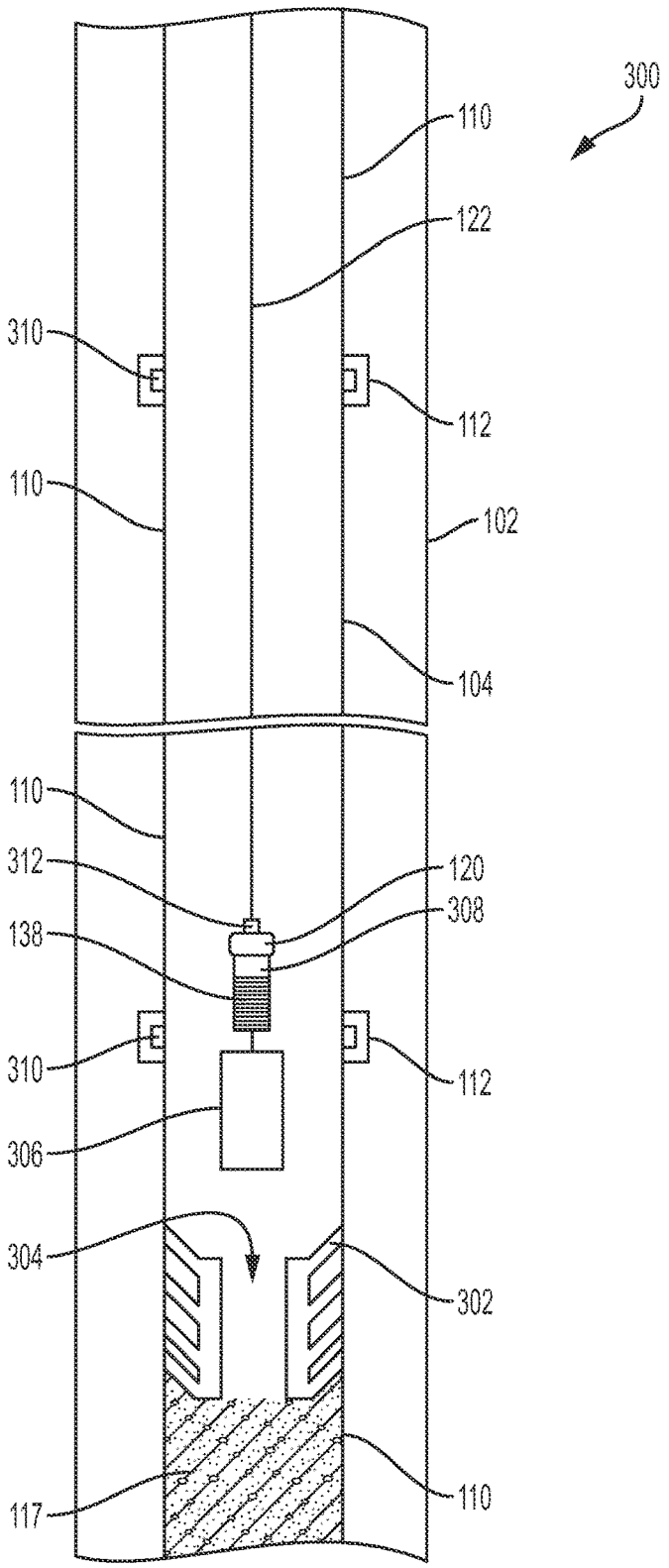
FIG. 3 is a schematic diagram of a well system for cementing a wellbore and tracking a cementing tool, according to another example of the present disclosure.

FIG. 3 is a schematic diagram of another example of a well system 300 for tracking the location of a cementing tool that includes a locator device that is a radio frequency identification ("RFID") reader. A cement plug 302 having an opening 304 can be lowered into the wellbore 102 within the casing tube 110 of the casing string 104. The cement 117 can be pumped into the wellbore 102 and can pass through the opening 304 of the cement plug 302. After the desired amount of cement 117 has been pumped into the wellbore 102 a cementing tool, for example a dart 306, can be launched from the surface to dock with and seal the opening 304. The dart 306 can be forced downhole by the injection of the displacement fluid from the surface.

The RFID reader 308 can be coupled proximate to the dart 306. The RFD reader 308 can detect a change in a magnetic field (e.g., a signal) associated with one or more RFID tags 310 in response to an RFID tag 310 being in a detectable range of the RFID reader 308. The RFID tags 310 can be positioned proximate to the casing collars 112 prior to the casing tubes 110 being positioned within the wellbore 102. In some aspects, the RFID tags 310 can be positioned elsewhere in the wellbore 102, for example at a float collar at the bottom of the casing string 104, The RFID reader 308 can generate an electrical signal in response to detecting one or more of the RIM tags 310. The RFID reader 308 can be coupled to the LED 120 or another suitable light source and the lower reel 138.

The dart 306 can be forced downhole by the injection of displacement fluid from the surface 106. The RFD reader 308, the LED 120, and the lower reel 138 can move downhole with the dart 306. The RFID reader 308 can generate and transmit an electrical signal to the LED 120 in response to detecting an RFID tag 310. The LED 120 can generate a pulse of light in response to the RFID reader 308 detecting the RFID tag 310. The pulse of light can be transmitted to the receiver at the surface by the fiber optic cable 122. The location of the dart 306 can be determined based on the number of light pulses detected by the receiver. The location of the dart 306 can be monitored as the dart 306 travels downhole to dock with the cement plug 302 and seal the opening 304. Once the dart 306 has docked with the cement plug 302, both devices can be forced downhole by displacement fluid injected from the surface until the cement plug 302 and dart 306 contact the lower cement plug. As the cement plug 302 and the dart 306 continue to travel downhole the location of the cement plug 302 and the dart 306 can be monitored.

An additional sensor 312 can be coupled to the fiber optic cable 122 for monitoring a condition within the wellbore 102. In some aspects, the additional sensor 312 can be a temperature sensor, an acoustic sensor, a sheer sensor, a pressure sensor, an accelerometer, a chemical sensor, or other suitable sensor. The additional sensor 312 can monitor a condition within the wellbore 102 and transmit information regarding the condition to the receiver via the fiber optic cable 122 some aspects, the receiver can include a transmitter for transmitting commands to the additional sensor 312 via the fiber optic cable 122. In some aspects, more than one additional sensor 312 may be utilized.

In some aspects, the tracking of a cementing tool is provided according to one or more of the following examples:

Example #1

A system can include a cementing tool that is positionable within a casing string of a wellbore. A receiver can be positioned at a surface of the wellbore for receiving an optical signal. A locator can be coupled to the cementing tool for generating an electrical signal in response to detecting a change in a surrounding magnetic field. A light source can generate the optical signal. A fiber optic cable can transmit the optical signal generated by the light source. A fiber reel can dispense the fiber optic cable from one end of the fiber optic cable. The fiber reel can dispense the fiber optic cable in response to a tension in the fiber optic cable.

Example #2

The system of Example #1 may include an additional fiber reel that can also dispense the fiber optic cable from a second end of the fiber optic cable.

Example #3

The system of any of Examples 41-2 may further include a drag device on the fiber reel for preventing the fiber optic cable from being dispensed when the tension in the fiber optic cable is less than a pre-set value.

Example #4

The system of any of Examples #1-#3 may feature an RFID receiver or a magnetic pickup coil as the locator.

Example #5

The system of any of Examples #1-4 may feature the light source being coupled to the locator for generating the optical signal in response to the electrical signal from the locator.

Example #6

The system of any of Examples #1-5 may further include a modulation device that can be coupled to the locator for modulating the optical signal transmitted from the light source. The modulation device can modulate the optical signal in response to the electrical signal from the locator.

Example #7

The system of any of Examples #1-6 may further feature the fiber optic cable being embedded in a soft binder for holding one or more turns of the fiber optic cable together around the fiber reel.

Example #8

The system of any of Examples 41-7 may feature the fiber optic cable being an unarmored fiber optic cable.

Example #9

A system can include a light source that can generate an optical signal. The light source can generate the optical signal in response to receiving an electrical signal from a locator. A receiver can detect the optical signal and can convert the optical signal into electricity. A fiber optic cable can transmit the optical signal and a fiber reel can dispense the fiber optic cable from one end of the fiber optic cable. The fiber reel can dispense the fiber optic cable in response to a tension in the fiber optic cable.

Example #10

The system of Example #9 may further include an additional reel that can dispense the fiber optic cable from a second end of the fiber optic cable.

Example #11

Any of the systems of Examples #9-10 may further feature a drag device that is included in the fiber reel. The drag device can prevent the dispensing the fiber optic cable in response to the tension in the fiber optic cable being less than a pre-set value.

Example #12

Any of the systems of Examples #9-11 may feature an RFID reader as the locator. The RFID reader can detect a change in a surrounding magnetic field in response to an RFID tag being in a detectable range, as the locator.

Example #13

Any of the systems of Examples 49-11 may feature a magnetic pickup coil that includes a permanent magnet and a coil as the locator. The magnetic pickup coil can generate a voltage in response to detecting a change in a surrounding magnetic field.

Example #14

Any of the systems of Examples #9-13 may further include a modulation device that can be coupled to the locator. The modulation device can modulate the optical signal in response to the electrical signal from the locator.

Example #15

A method for tracking a cementing tool using fiber optics can include generating an electrical signal by a locator positionable in a wellbore, The electrical signal can be generated in response to the locator detecting a change in a surrounding magnetic field. An optical signal can be generated by a light source. The optical signal can be transmitted by a fiber optic cable. The optical signal can be detected by a receiver. The fiber optic cable can be dispensed from one end of the fiber optic cable by a fiber reel. The fiber optic cable can be dispensed in response to a tension in the fiber optic cable.

Example #16

The method of Example 15 may include dispensing the fiber optic cable from a second end of the fiber optic cable by an additional fiber reel. The fiber optic cable can be dispensed by the additional fiber reel in response to the tension in the fiber optic cable.

Example #17

The method of any of Examples #15-16 may include transmitting, by a communication link, information regarding the optical signal away from the receiver.

Example #18

The method of any of Examples #15-#18 may include modulating the optical signal by a modulation device in response to the electrical signal. The modulation device can be positioned within the wellbore and the light source can be positioned at a surface of the well bore.

Example #19

The method of Example #18 may include modulating the optical signal by positioning a mirror to reflect the optical signal in a desired direction. The modulation device can be a pendulum switch that includes the mirror.

Example #20

The method of any of Examples #18-19 may include generating the optical signal by the light source in response in response to the electrical signal.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a cementing tool positionable within a casing string of a wellbore, the casing string comprising a first casing tube coupled to a second casing tube via a casing collar, wherein the first and second casing tubes emit a first magnetic field and the casing collar emits a second magnetic field that is different from the first magnetic field;

a receiver positionable at a surface of the wellbore for receiving an optical signal;

a locator coupled to the cementing tool for generating an electrical signal in response to detecting a change in a surrounding magnetic field corresponding to a difference between the first magnetic field of the first and second casing tubes and the second magnetic field of the casing collar;

a light source for generating the optical signal;

a fiber optic cable for transmitting the optical signal; and a fiber reel for dispensing the fiber optic cable from an end of the fiber optic cable in response to a tension in the fiber optic cable.

2. The system of claim 1, further comprising an additional fiber reel for dispensing the fiber optic cable from a second end of the fiber optic cable.

3. The system of claim 1, wherein the fiber reel includes a drag device for preventing the dispensing the fiber optic cable in response to the tension in the fiber optic cable being less than a pre-set value.

4. The system of claim 1, wherein the locator is a radio frequency identification (RFID) receiver or a magnetic pickup coil.

5. The system of claim 1, wherein the light source is coupled to the locator for generating the optical signal in response to the electrical signal from the locator.

6. The system of claim 1, further comprising a modulation device coupled to the locator, the modulation device comprising a pendulum switch including a mirror for modulating the optical signal transmitted from the light source in response to the electrical signal from the locator.

7. The system of claim 1, wherein the fiber optic cable is embedded in a soft binder for holding one or more turns of the fiber optic cable together around the fiber reel.

8. The system of claim 1, wherein the fiber optic cable is an unarmored fiber optic cable.

9. A system comprising:

a light source for generating an optical signal in response to receiving an electrical signal from a locator in response to detecting a magnetic field emitted by a casing collar coupling together two casing tubes;

a receiver for detecting the optical signal and converting the optical signal into electricity;

a fiber optic cable for transmitting the optical signal; and a fiber reel for dispensing the fiber optic cable from an end of the fiber optic cable in response to a tension in the fiber optic cable.

10. The system of claim 9, further comprising an additional reel for dispensing the fiber optic cable from a second end of the fiber optic cable.

11. The system of claim 9, wherein the fiber reel includes a drag device for preventing the dispensing the fiber optic cable in response to the tension in the fiber optic cable being less than a pre-set value.

12. The system of claim 9, wherein the locator is a radio frequency identification (RFID) reader for detecting a change in a surrounding magnetic field in response to an RFID tag being in a detectable range.

13. The system of claim 9, wherein the locator is a magnetic pickup coil that includes a permanent magnet and a coil for generating a voltage in response to detecting the magnetic field emitted by the casing collar.

14. The system of claim 9, further comprising a modulation device coupled to the locator, the modulation device comprising a pendulum switch including a mirror for reflecting the optical signal in a desired direction for modulating the optical signal in response to the electrical signal from the locator.

15. A method comprising:

generating, by a locator positionable in a wellbore, an electrical signal in response to detecting a change in a surrounding magnetic field;

generating, by a light source, an optical signal;

transmitting, by a fiber optic cable, the optical signal;

modulating, by a modulation device positionable within the wellbore, the optical signal in response to the electrical signal, detecting, by a receiver, the optical signal; and dispensing, by a fiber reel, the fiber optic cable from an end of the fiber optic cable in response to a tension in the fiber optic cable, wherein modulating, by the modulation device positionable within the wellbore, the optical signal further comprises positioning a mirror to reflect the optical signal in a desired direction, wherein the modulation device comprises a pendulum switch that includes the mirror.

16. The method of claim 15, further comprising dispensing, from an additional fiber reel, the fiber optic cable from a second end of the fiber optic cable in response to the tension in the fiber optic cable.

17. The method of claim 15, further comprising transmitting away from the receiver, by a communication link, information regarding the optical signal.

18. The method of claim 15, wherein generating, by the light source, the optical signal further comprises generating the optical signal in response to the electrical signal.

19. A system comprising:

a light source for generating an optical signal in response to receiving an electrical signal from a locator;

a receiver for detecting the optical signal and converting the optical signal into electricity;

a fiber optic cable for transmitting the optical signal;

a fiber reel for dispensing the fiber optic cable from an end of the fiber optic cable in response to a tension in the fiber optic cable; and a modulation device comprising a pendulum switch including a mirror for reflecting the optical signal in a desired direction for modulating the optical signal in response to the electrical signal from the locator.

* * * * *